US005157228A

United States Patent [19]

Ackermann et al.

[11] Patent Number: 5,157,228

[45] Date of Patent: Oct. 20, 1992

[54] ADJUSTING TECHNIQUE FOR A DIGITAL ELEVATOR DRIVE SYSTEM

[75] Inventors: Bernd L. Ackermann; Peter L. Herkel; Herbert K. Horbruegger; Mustapha Toutaoui, all of Berlin, Fed. Rep. of Germany

[73] Assignee: Otis Elevator Company, Farmington, Conn.

[21] Appl. No.: 589,862

[22] Filed: Sep. 28, 1990

[51] Int. Cl.[5] ..... B66B 1/06

[52] U.S. Cl. ..... 187/112; 187/130

[58] Field of Search ..... 187/108, 119, 115, 133, 187/122, 112, , 120; 388/806, 804; 318/743

[56] References Cited

U.S. PATENT DOCUMENTS

| | | | |
|---|---|---|---|
| 3,584,706 | 6/1971 | Hall et al. | 187/116 |
| 3,811,079 | 5/1974 | Tashiro et al. | 388/804 |
| 3,876,918 | 4/1975 | Komuro et al. | 318/743 |
| 3,938,624 | 2/1976 | Maynard | 187/120 |
| 3,973,648 | 8/1976 | Hummert et al. | 187/133 |
| 4,099,111 | 7/1978 | Inaba et al. | 388/806 |
| 4,319,665 | 3/1982 | Komuro et al. | 187/119 |
| 4,512,442 | 4/1985 | Moore et al. | 187/133 |
| 4,553,640 | 11/1985 | Inaba et al. | 187/115 |
| 4,658,935 | 4/1987 | Holland | 187/122 |
| 4,870,334 | 9/1989 | Iwasa et al. | 187/119 |
| 4,975,627 | 12/1990 | Reddy | 187/108 |

FOREIGN PATENT DOCUMENTS

| | | |
|---|---|---|
| 0366097 | 5/1990 | European Pat. Off. . |
| 2180960A | 9/1986 | United Kingdom . |

*Primary Examiner*—A. D. Pellinen
*Assistant Examiner*—Lawrence E. Colbert
*Attorney, Agent, or Firm*—Francis J. Maguire, Jr.

[57] ABSTRACT

Automatic and manual adjustment of a new elevator system installation is accomplished by means of a service tool for interacting with software resident in the elevator system whereby various control parameters such as the feed forward gain of the drive system, the start time delay for delaying initiation of a start torque profile for bypassing the velocity loop during starting, the polarity of the feedback signals, e.g., armature current, velocity, motor field current, and other parameters, may be adjusted automatically, while others, such as the impedance of an elevator brake, may be adjusted by a technician responding to automatic prompts.

9 Claims, 12 Drawing Sheets

| IN CASE OF SIGN FAULT OF... | | | CHANGE SIGN OF... | | |
|---|---|---|---|---|---|
| SENSED SPEED (V) | SENSED ARMATURE CURRENT ($I_A$) | DIRECTION OF CAR MOVEMENT | SPEED ENCODER | $I_A$ | ALPHA GF + $R_{DIR}$ |
| | | X | X | X | X |
| | X | | | X | |
| | X | X | X | | X |
| X | | | X | | |
| X | | X | | X | X |
| X | X | | X | X | |
| X | X | X | | | X |

(b)

(c)

ADJUSTING TECHNIQUE FOR A DIGITAL ELEVATOR DRIVE SYSTEM

REFERENCE TO RELATED APPLICATIONS

The invention described herein may employ some of teachings disclosed and claimed in commonly owned copending applications filed on even date herewith by Horbruegger et al, U.S. Ser. No. 07/589,859 entitled "Adaptive Digital Armature Current Control Method for Ward-Leonard Drives Using an SCR Generator Field Amplifier"; by Ackermann et al, U.S. Ser. No. 07/589,860 entitled "Control of a Discontinuous Current by a Thyristor Rectifier with Inductive Load"; and by Horbruegger et al, U.S. Ser. No. 07/589,861 entitled "Elevator Start Control Technique for Reduced Start Jerk and Acceleration Overshoot."

TECHNICAL FIELD

This invention relates to elevators, and more particularly, electric control systems and devices therefor.

BACKGROUND ART

It has always been the case that at least several parameters of a newly installed elevator drive control system have to be adjusted during the installation phase of the system to achieve optimal riding performance of the elevator. In such cases, the design parameters are known in advance, and construction technicians, adjusters or mechanics can be instructed in the installation of new or modernized controls through utilizing relatively simple documentation on how and what parameters to adjust by means of potentiometers, variable inductors, hookups, jumpers, software, etc. It goes without saying, however, that special knowledge of the system behavior and sometimes expensive tools, such as oscilloscopes, strip-chart recorders, spectrum analyzers, protocol analyzers, etc., are necessary in order to properly set up the system.

As elevator systems become more complex and product lines more differentiated, the range of tools, the volume of instructions, and the specialized knowledge in order to carry out the setup process sometimes becomes quite burdensome and difficult to execute logistically with the proper personnel with the proper knowledge at the right place and time.

Attempts have been suggested to alleviate the burden on the installation adjuster by providing a portable personal computer (PC) having a data base and algorithm that presents menus to the adjuster for his easy selection of items by which the elevator system may be measured and tuned, using virtual measuring and tuning components operated by means of the programs of the computer. See, for example, European Patent Application No. 89 119770.9 published under Publication No. 0 366 097 A1 on Feb. 2, 1990. In that disclosure, the PC is temporarily connected to a microprocessor-controlled elevator system for operating as a virtual instrument so that the task of assembling and carrying a number of discrete measuring devices, e.g., an oscilloscope, a strip-chart recorder, and a spectrum analyzer, can be avoided by the simple substitution of a single "virtual" instrument capable of emulating any or all of these instruments. Moreover, the programs of the computer can be devised, according to that disclosure, to enable a single apparatus to be used for the tuning and measurement of the whole elevator system and to improve the standard of timing and measurements. The disclosure further suggests remote monitoring and tuning by means of telephone lines without entering the machine room which can be operated by technicians of different skill levels, depending on a hierarchy of skills as set forth. Large elevator groups or elevators similar to each other can be started up faster because tuning parameters can be transferred from one elevator to another. No separate measuring instruments are needed because the system employs a computer which comprises all the necessary virtual components, for example, in the form of icons symbolizing operations that functionally correspond to the operation of a real, physical instrument or component. It is easier to use virtual instruments than general-purpose instruments, and the designer can provide for different skill levels in carrying out tuning operations so that a person does not need a profound knowledge of the system in order to carry out the tuning operations as instructed by the computer program because the computer provides step-by-step guidance.

Another attempt to utilize the power of a computer to minimize installation-specific work is disclosed in U.K. Patent Publication GB 2 180 960 A, published Apr. 8, 1987, corresponding to Application No. 86 22202 filed Sep. 15, 1986. Prior to commissioning a lift, a test program maps all action means used in particular installation and their positions by sending out queries to various addresses representing all action means that are possible and by inferring the kind and number of action means present in the installation on the basis of the answers received. A test run is made in order to infer the geometry of the building and the distances between floors. All the necessary information is stored with a view to controlling the elevator permanently, based on the information so obtained. That approach seeks to eliminate much of the "contract engineering" work that is traditionally required for modifying a software "baseline" for each building in which a manufacturer's product is installed. It has been calculated, according to the disclosure, that the installation-specific planning consumes up to over 20% of the working time spent in making the lift at the manufacturing plant, when the lift is a standard product. However, this approach cannot eliminate many contract engineering functions, such as specific customer requests for particular types of service, speeds, and other options. Moreover, one of the more troubling adjustment problems is the relatively complex task of adjusting the drive system. Such cannot be even approached without further information on how or whether such a complex adjusting problem can be undertaken.

Setup problems can be especially difficult in drive systems which are used for modernization of older systems. In order to achieve maximum economy, some of the older and more expensive components of the system are retained, such as the elevator drive motor, hoistway components, wiring, and other components which have a very long life and which would be needlessly replaced. A problem can be that, in many cases, the original, historical design parameters for such older motors are not known (even to the original manufacturers or their successors), because a generation or more may have passed since the original installation. In that case, there is still a requirement for the modernization package to be tuned to the existing elevator installation and the wide range of possible parameter values is completely unknown.

DISCLOSURE OF INVENTION

The object of the present invention is to provide self-adjusting technique for a digital elevator drive system.

According to the present invention, a drive system is made able to adjust itself automatically.

In further accord with the present invention, the elevator drive system is designed to use information the system obtains by means of its internal signals to tune itself.

In still further accord with the present invention, the information obtained from the internal signals of the system is used to display sufficient information to enable the adjuster to make appropriate hardware adjustments. This may be accomplished by means of built-in display devices or by means of an interchange of signals between a service tool and the elevator control system connected thereto.

In still further accord with the present invention, the setup of control parameters can be subdivided into sensitive parameters that have a severe influence on the drive performance which will be adjusted and others that can be set to values that will have a fixed relationship to those sensitive parameters that will be adjusted.

In still further accord with the present invention, the adjusting can be performed by special software driven in operational modes internal to the elevator system itself. These may include special excitation of control loops and the processing of feedback signals. Thus, each software control parameter, e.g., a regulated gain or time constant, may be tuned by a special software routine, which may be set up to execute automatically upon initiation at the time of installation. Of course, some devices within any elevator control may be manually adjustable, and therefore it may often be necessary, for example, to adjust resistors in the controller cabinet. In this case, the drive system may be configured to provide precise information concerning the adjustment that needs to be made.

In still further accord with the present invention, the various adjusting procedures disclosed herein may be performed during stand-alone operation of various subsystems of the elevator system. For example, a drive and brake subsystem may be decoupled from other subsystems during initial "exercising" to determine needed adjustments or while actually making such adjustments. After finishing a stand-alone adjustment, the other elevator control systems are reconnected. This may be done automatically or by virtue of actual disconnections and reconnections. In this way, the setup of the complete control system may be decoupled from the tuning of other subsystems, such as the drive.

In still further accord with the present invention, the polarity of the feedback signals, e.g., armature current, velocity, motor field current, are checked by means of checking the connections and observing the run direction.

In still further accord with the present invention, a brake resistor adjustment can be made to obtain a smooth brake lift in order to reduce start jerk of the elevator.

In still further accord with the present invention, the motor field current may be adjusted automatically.

In still further accord with the present invention, the feed forward gain of the drive system may be automatically adjusted.

In still further accord with the present invention, and as further disclosed in copending application U.S. Ser. No. 07/589,861, entitled "Elevator Start Control Technique for Reduced Start Jerk and Acceleration Overshoot", a start time delay for delaying initiation of a start torque profile which bypasses the velocity loop during starting, may be adjusted automatically.

Many of the disclosed implementations herein may be specifically disclosed for a Ward-Leonard modernization drive system. Thus, some adjustment routines are tailored for the special operating behavior of a Ward-Leonard drive. However, these and other routines may be altered or used in general for other drive systems.

These and other objects, features and advantages of the present invention will become more apparent in light of the detailed description of exemplary embodiments thereof, as illustrated in the accompanying drawing.

BEST MODE FOR CARRYING OUT THE INVENTION

Figure 1A:
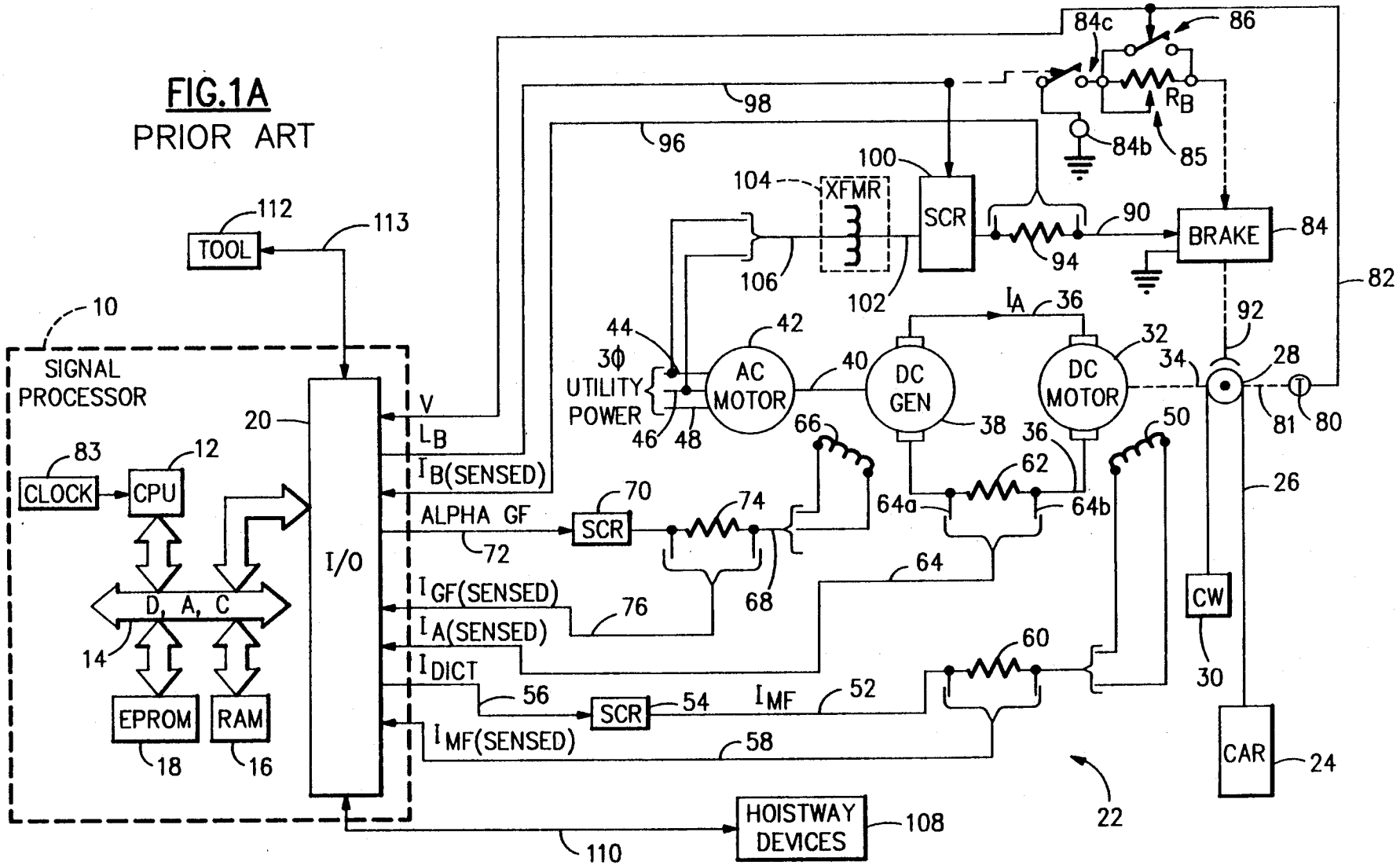
FIG.1A PRIOR ART
FIG. 1A is an illustration of an elevator system susceptible to adjustment by methods disclosed herein in accordance with the teachings of the present invention.

FIG. 1A illustrates a signal processor 10 which is illustrated as a microprocessor but which may be any discrete or integrated circuit which carries out the functions to be described hereinafter. The signal processor comprises a central processing unit (CPU) 12 which communicates with a data, address and control (D,A,C) bus 14, also in communication with a random access memory (RAM) 16, and electrically erasable, programmable, read-only memory (EPROM) 18, and an input-/output (I/O) device 20.

The signal processor 10 of FIG. 1A is shown interfacing with an elevator system 22 including a car 24 having a rope 26 laid over a sheave 28 attached to a counterweight 30 in a hoistway in a building. The sheave 28 is driven by a motor which in the case illustrated in FIG. 1A, is a Ward-Leonard control system having a DC motor, having its output shaft 34 attached to the sheave 28 and having its armature energized by an armature current ($I_A$) on a line 36 provided by a DC generator 38 which is in turn driven by a shaft 40 of an AC motor 42. Three-phase utility power on lines 44, 46, 48 is provided to the AC motor 42 for driving it at constant speed corresponding to the frequency of the utility. A field winding 50 of the DC motor 32 is energized by a motor field current ($I_{MF}$) on a line 52 provided by an SCR circuit 54 controlled by a motor field dictation current on a line 56 from the signal processor's I/O device 20. A sensed motor field current signal is provided to the signal processor 10 on a line 58 and may be obtained by means of a small resistance 60 inserted in series with the signal line 52. A small voltage drop is provided across the resistor from which the motor field current may be inferred.

Similarly, the armature current on line 36 may be sensed by inserting a resistor 62 in the armature line 36 in order to provide a voltage on a pair of lines **64*a*, 64*b*, which together constitute a sensed armature current signal on a line 64 to the I/O device 20. Similarly, one of the pair of lines 64*a*, 64*b***, may be utilized to indicate the magnitude of the armature voltage (VA).

A DC generator field winding 66 is energized by a signal on a line 68 from an SCR circuit 70 controlled by a torque command signal (ALPHA GF) on a line 72 from the I/O device 20. A resistor 74 in the signal line 68 provides a voltage drop on a signal line 76 indicative of the magnitude of the generator field current to the I/O device 20.

A tachometer 80 attached by means of a linkage or shaft 81 to the sheave or motor shaft 34 provides a sensed velocity signal on a line 82 to the I/O device 20. Of course, it will be realized that the tachometer 80 may be a position sensor and the signal on line 82 may be a position signal from which may be inferred velocity based on an internal clock 83 within the signal processor 10.

Figure 1C:
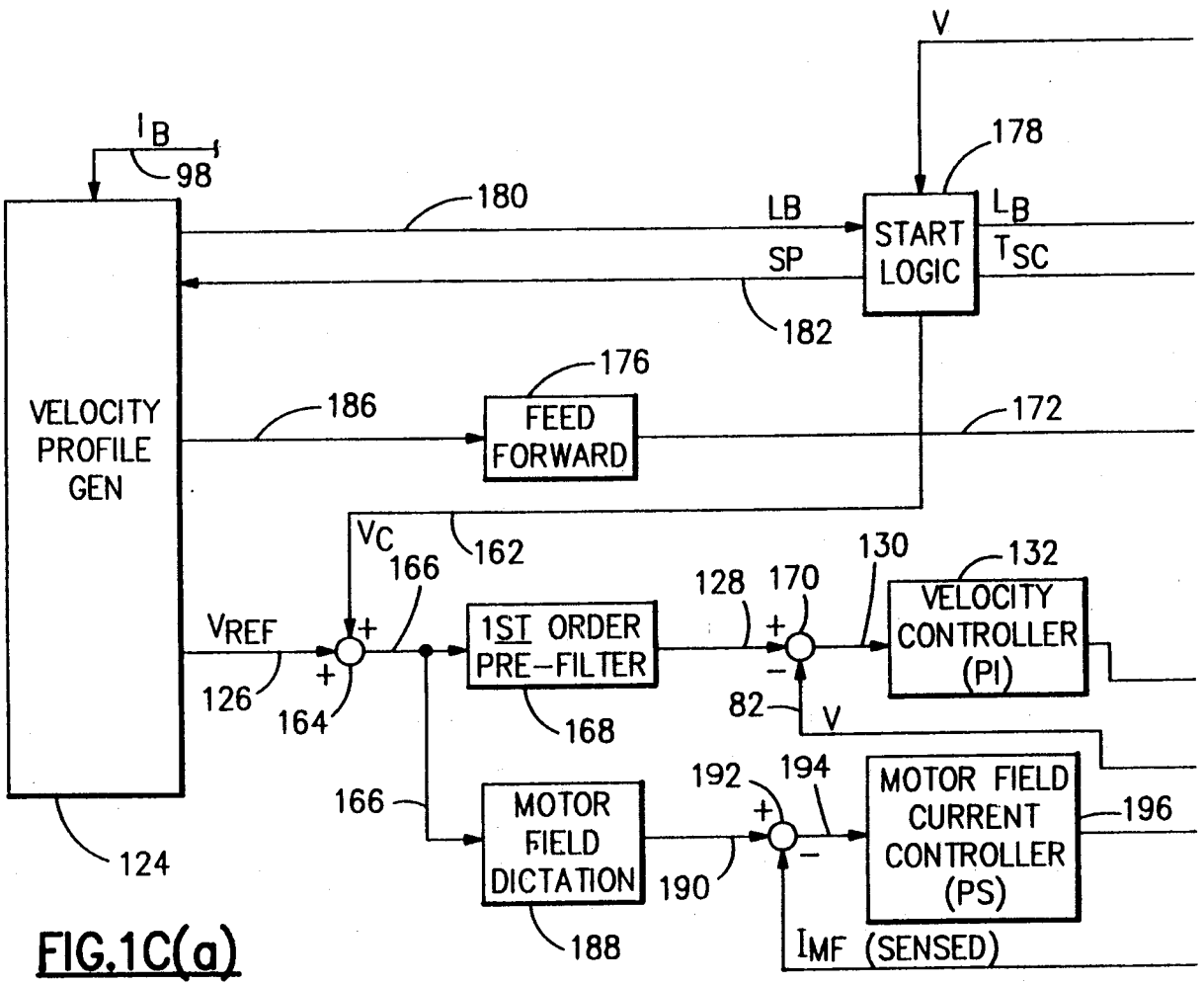
FIG.1C(a) PRIOR ART
FIG. 1C shows the same hardware of FIG. 1A except for showing the signal processor in functional blocks.
Figure 1C:
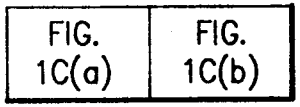
Figure 1C:
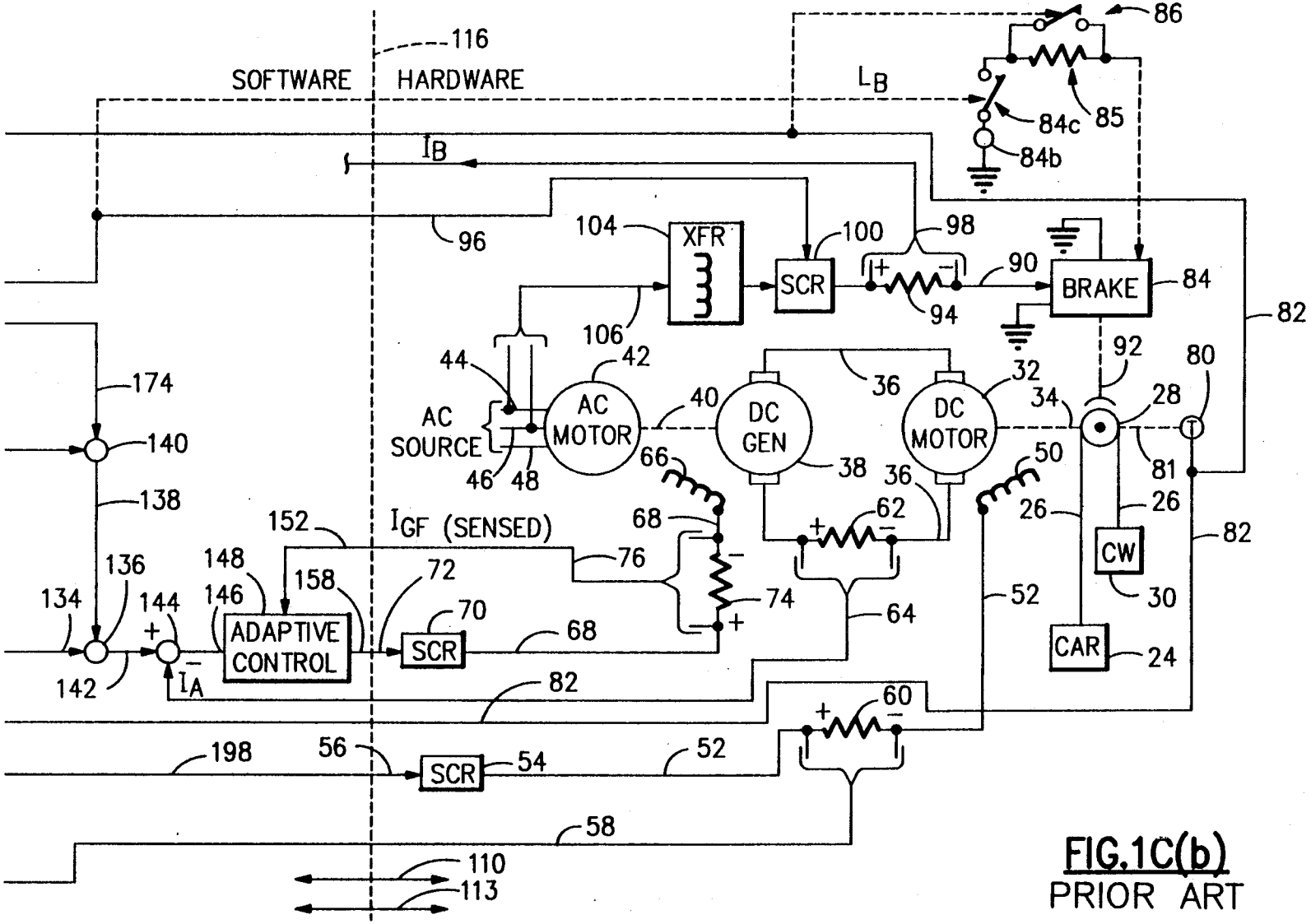
FIG.1C(b) PRIOR ART
Figure 1B:
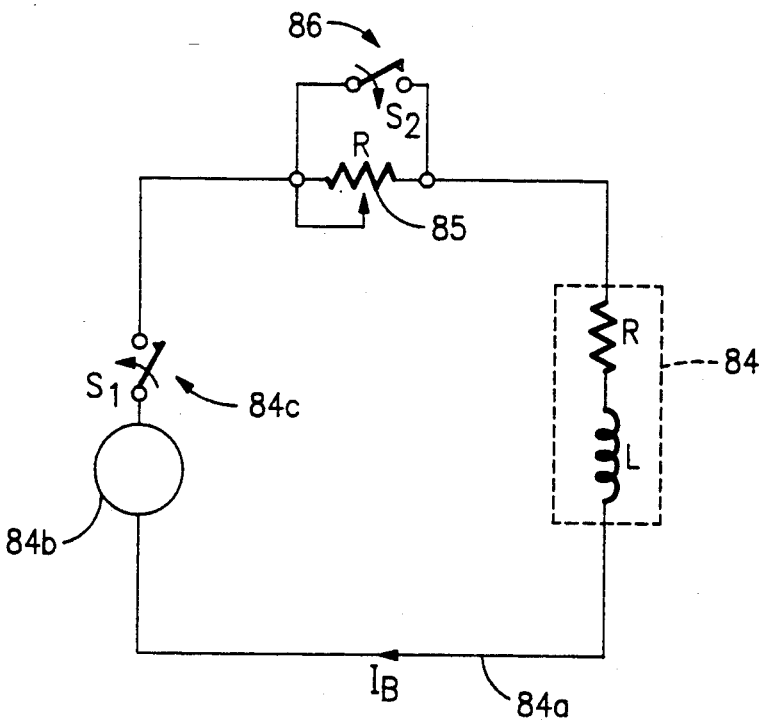
FIG.1B PRIOR ART
FIG. 1B shows an electrical arrangement which allows smoothing of the brake release.

A brake 84, as shown in FIG. 1B, (on sheet 8 with FIG. 2F) represented by a resistance and an inductance, may be energized by a brake current ($I_B$) on a line **84*a* from a voltage source 84*b* provided upon closure of a switch 84*c*. An adjustable resistor 85 permits the exponential size of the brake current to be adjusted in slope according to a desired smoothness for brake release as shown subsequently in connection with FIGS. 4 and 11. Another switch 86 may be provided which will be open during the initial brake opening process in order to provide the desired degree of moving but which will be closed to short out resistor 85** after detecting car motion, as described fully in connection with copending application U.S. Ser. No. 07/589,861.

The smooth operation of the brake can also be achieved by other techniques, such as an open loop control of the brake voltage (ramp up of brake voltage) or a closed loop control of the brake current. The open loop technique of FIG. 1B is presently preferred and is shown connected by dotted lines in FIGS. 1A and 1C.

For example, the brake 84 may be energized as shown in FIGS. 1A and 1C in a closed loop control by a DC brake current ($I_B$) on a line 90 which, when energized, causes a restraining device 92 to be lifted, for example, from the sheave 28 in order to permit it to rotate. The brake current on the line 90 is sensed by means of a resistor 94 which provides a sensed brake current signal on a line 96 to the I/O device 20. A lift brake ($L_B$) signal on a line 98 is provided to an SCR circuit 100 which provides the brake current on the line 90 in response to a stepped-down AC voltage on a line 102 provided by a transformer 104, which is in turn energized by a line 106 which may be a single phase AC voltage obtained, for example, from two of the three phase utility power lines 44, 46.

A number of hoistway devices, 108 such as position sensors, call buttons, indicators, and car buttons and indicators (not shown) provide signals by means of a traveling cable symbolized by a signal line 110.

A service tool 112, which may be a "dumb" terminal or a "smart" terminal, as the case may be, is used by a service technician to carry out the methods claimed herein. It or the elevator system itself may embody some of the routines for carrying out these methods in software.

Thus, although many of the software structures to be disclosed in FIGS. 1C and 2A–2F are impliedly embodied in the elevator's controller itself, it should be understood by those skilled in the art, that these same structures or portions thereof, may instead be resident in memory embodied in the tool 112.

Turning now to FIG. 1C, a dashed line 116 is there shown to separate the hardware functions of the figure from a preferred software embodiment of the invention residing in the elevator controller itself. The hardware shown on the right side of dashed line 116 in FIG. 1B is the same as that shown in FIG. 1A.

As mentioned, the software functions shown on the left of the dashed line 116 in FIG. 1B are functional block which are carried out in software routines which may be stored in an EPROM 18, such as is shown in the signal processor 10 of FIG. 1A. These routines may be executed in any number of different approaches which will be apparent to those skilled in the art of programming based on the description of the functional blocks to be described herein. It should be understood that although many very detailed functional blocks are to be described, many of these functions are somewhat peripheral to the invention disclosed herein and are disclosed for purposes of completeness and form the context of the invention, rather than a limitation thereof.

In a Ward-Leonard control system, which is well known in the art, it is typically the case that the DC generator 38 has its field 66 excited in order to generate an armature current on line 36 of sufficient magnitude to accelerate the DC motor 32 in conformance with a speed profile provided by a velocity generator 124 which provides a velocity profile signal ($V_{REF}$) on a line 126. The velocity profile generator was, in former days, carried out in discrete components located in one or more controllers. Such components included relatively large size resistors and relay switches for shorting out portions of the resistors in steps so as to weaken or strengthen the generator field, depending on the degree of acceleration desired. These functions may now be carried out in software, as suggested herein by the functional block 124 which is well known in the art of producing such velocity profiles in software. It is the practice in the art to start up the system using the velocity reference signal on line 126 from the inception of a command to start the elevator which may be generated in response to other control functions such as a group control function (not shown).

In the case of copending application U.S. Ser. No. 07/589,861 entitled "Elevator Start Control Technique for Reduced Start Jerk and Acceleration Overshoot" by the same inventors, this technique is changed in order to decouple the closed loop velocity control system typically used for controlling a Ward-Leonard system during the starting phase and using an open loop torque profile on starting in substitution therefor. Although the present disclosure shows the software structures in such a way as to be in keeping with that other disclosure, it should be realized by those skilled in the art that the present invention is not limited to setup of a drive system using that sort of a start technique. It is intended that the invention be usable on prior art approaches as well as other approaches which are existing or contemplated for use in controlling elevator drive systems. Indeed, the present invention is not restricted to Ward-Leonard drive systems but may be used as well on other types of systems, such as direct drive systems such as shown in FIG. 21 of the previously referred to copending application, or a VF system, such as shown in FIG. 22 of that specification. It should also be understood that the invention is broadly applicable to other types of systems as well and that the present disclosure merely serves as a vehicle for showing a preferred embodiment in a Ward-Leonard system in which the invention is contemplated for first use by the inventors.

A velocity control loop comprises a filtered velocity command signal on a line 128 which is compared to a sensed velocity signal on the line 84. The difference therebetween is provided as a difference signal on a line 130 to a velocity controller 132, which may be of the proportional-integral type, and which provides an output signal on a line 134 to a summing junction 136 responsive to a summed signal on a line 138 from a summing junction 140. The summing junction 136 provides a summed signal on a line 142 to a summing junction 144 responsive to the sensed armature current on line 64. A difference signal on a line 146 is provided to an adaptive armature current controller 148. The adaptive controller 148, described in detail in copending application U.S. Ser. No. 07/589,859, provides a control signal on a line 158 to the SCR circuit 70 for controlling the magnitude of the generator field current on line 68. Since the magnitude of the current on line 68 controls the magnitude of the armature current on line 36, it thereby controls the speed of the DC motor 32 which is sensed by the tachometer 80 and manifested by the velocity feedback on line 82, which together constitute a closed loop velocity control system.

As mentioned previously, in the copending application U.S. Ser. No. 07/589,801, the velocity reference profile on line 126 is held in abeyance during the starting process and, although the velocity loop is still operative, it is merely provided with a small magnitude creep velocity signal on a line 162, which is added to the zero magnitude reference profile signal on line 126 in a summer 164 which provides a summed signal on a line 166 to a filter 168, which in turn provides a filtered signal on line 128 to a summing junction 170, which was previously described for summing the signals on lines 82 and 128.

As also previously mentioned, the output of the velocity controller 132, which attempts to zero the input signal on line 130, is summed to a signal on line 138 which represents the summation of a feed forward gain signal on a line 172 and a start control torque signal $T_{sc}$ on a line 174. These are provided respectively by a feed forward gain functional block 176 and a start logic functional block 178. The function of the start logic block 178 is fully disclosed in copending application U.S. Ser. No. 07/859,861 and will not be described in great detail here, except to say that it is responsive to a lift brake signal on a line 180 from the velocity profile generator 124 and, in response thereto, initiates the start control torque signal on line 174, which provides an increasing torque command signal on the line 174 until velocity is sensed on line 82, at which point the increase is stopped and the magnitude of the start command torque signal on line 174 is thereafter held constant. The velocity signal on line 82, to the start logic 178 once motion is indicated, initiates a start profile signal on a line 182 which causes the velocity profile generator 124 to begin providing the speed profile on the line 126. At the beginning of the process, the lift brake signal on the line 96, which may be the same as the lift brake signal on line 180, is provided to the SCR device 100 or alternatively the switch 84c in order to begin the brake lift process. The timing and slope of the start control torque signal on line 174 may be set up to cause the open loop start torque profile to level off and the velocity loop to begin tracking a velocity profile command signal at the point when the brake 92 has just lifted from the sheave 28. In this way, the prior art starting process, i.e., in which a closed loop velocity control system was used to command an increase of speed at the onset of motion, is decoupled and bypassed by an open loop start control torque signal which is tailored to avoid start jerk and acceleration at the moment of start-up, according to the copending application previously mentioned.

The feed forward functional block 176 is provided in order to dictate the magnitude of the signal on line 172 in such a way as to better control the acceleration and deceleration of the motor 32 during the whole running process. This may be done in the manner shown in abstract form in FIG. 1C by adding the magnitude of the signal on line 172 through a summing junction 140. In any event, the feed forward gain functional block 176 is controlled by an acceleration reference signal provided on a line 186 from the velocity profile generator 124.

Some manufacturers of elevators use a DC motor 32 which has a field winding of sufficient current carrying capacity to maintain a relatively large current for a long period of time without overheating and can therefore keep the DC motor field constant and control speed exclusively by control of the armature current on line 36. However, other manufacturers of elevator systems choose to economize on the size of the DC motor 32 windings and effectively utilize the DC motor field winding as an adjunct in the control of speed. In such a case, a motor field dictation functional block is required as shown in a block 188 and is responsive to the summed signal on line 166 for providing a motor field dictation current for a brief period of time typically near the end of the acceleration on start-up to running speed (e.g., after 80% of the desired speed has been achieved) and at the beginning of the slowdown deceleration until the speed declines to 80% of running speed, at which point the armature current control circuit utilizing the velocity control loop takes over the deceleration task. These techniques are known in the art and are not disclosed in detail. Suffice it to say that a control signal is provided on a line 190 and commands a motor field current level, which is compared in a summing junction 192 with the sensed motor field current on line 58. The difference therebetween is indicated by a difference signal on a line 194, which is provided to a PI controller 196 for controlling, by means of a control signal on a line 198, the SCR circuit 54 previously described in connection with FIG. 1A.

Several parameters of the drive control system have to be adjusted during the installation phase of the system to achieve optimal riding performance of the elevator. Especially drive systems which are used for modernization have to be tuned to the existing elevator installation, because of the wide range of parameter variation in the installed base of equipment of many different models and manufacturers.

Special knowledge of the system behavior and sometimes expensive tools like scopes or strip chart recorders are necessary to set up the system.

This invention disclosure describes a technique that makes the drive system itself able to adjust or guide a technician in adjusting all critical parameters.

The initial setup of the drive system is subdivided into the following tasks:

1. Check polarities of the feedback signals for consistency

In order to move an elevator in a desired direction, the polarities of factors that affect the run direction have to be in an appropriate combination. For example, for a given sense of rotation of the motor, the direction of the car movement depends on the direction in which the ropes are laid over the drive sheave. In the case of a Ward-Leonard drive, the factors determining the sense of rotation of the motor are:

the sense of rotation of the generator;
the polarity of the motor field; and
the polarity of the generator field.

For a closed loop control, in addition, the feedback values have to have the appropriate polarity. In the described case of a Ward-Leonard drive control, these values are:

motor speed;
armature current; and
motor field current.

Given conditions of an installation are the sense of rotation of the generator (due to the generator layout), the polarity of the motor field current feedback signal (due to the control layout), and the suspension of the car. Therefore, the sense of rotation of the generator and the correct connection of the motor field current sensor have to be checked visually. Three out of the four remaining factors, i.e., the polarities of the motor field, of the generator field, of the motor speed feedback signal (velocity V) and of the armature current feedback ($I_{A\,(sensed)}$) have to be set into an appropriate combination to achieve the desired run direction.

This can be done by hardware (rewiring) as well as by software. A software procedure is preferred in order to reduce expenditure. So, as the motor field direction cannot be changed by software, this was chosen to be the one keeping its polarity, i.e., left as is. In the described case, it was decided to correct the polarity of the motor speed feedback signal by hardware because the same hardware signal is used by another system within the elevator control. As in the described case, there is no additional device detecting the direction of the actual car movement, and this thus has to be checked visually and entered into the system by hand.

For an open loop run in the down direction under motoring conditions, the actual values of velocity (V on line 84), armature current ($I_{A\,(sensed)}$) on line 64) and car movement are measured. Open loop is chosen to avoid oscillations in case of a sign fault.

Feedback values of the armature current and of the motor field current being unequal to zero indicate that the system is working correctly in principle. Wrong polarity of the car movement or of the actual values of speed or armature current are defined as sign faults. Any combination of sign faults of these three values is caused by a certain combination of polarity errors of the speed encoder signal, the armature current signal, and the generator field. After receiving a request from a serviceman via the tool 112 to initiate setup, a program shown in FIG. 2A is entered at a step 200.

Figure 2A:
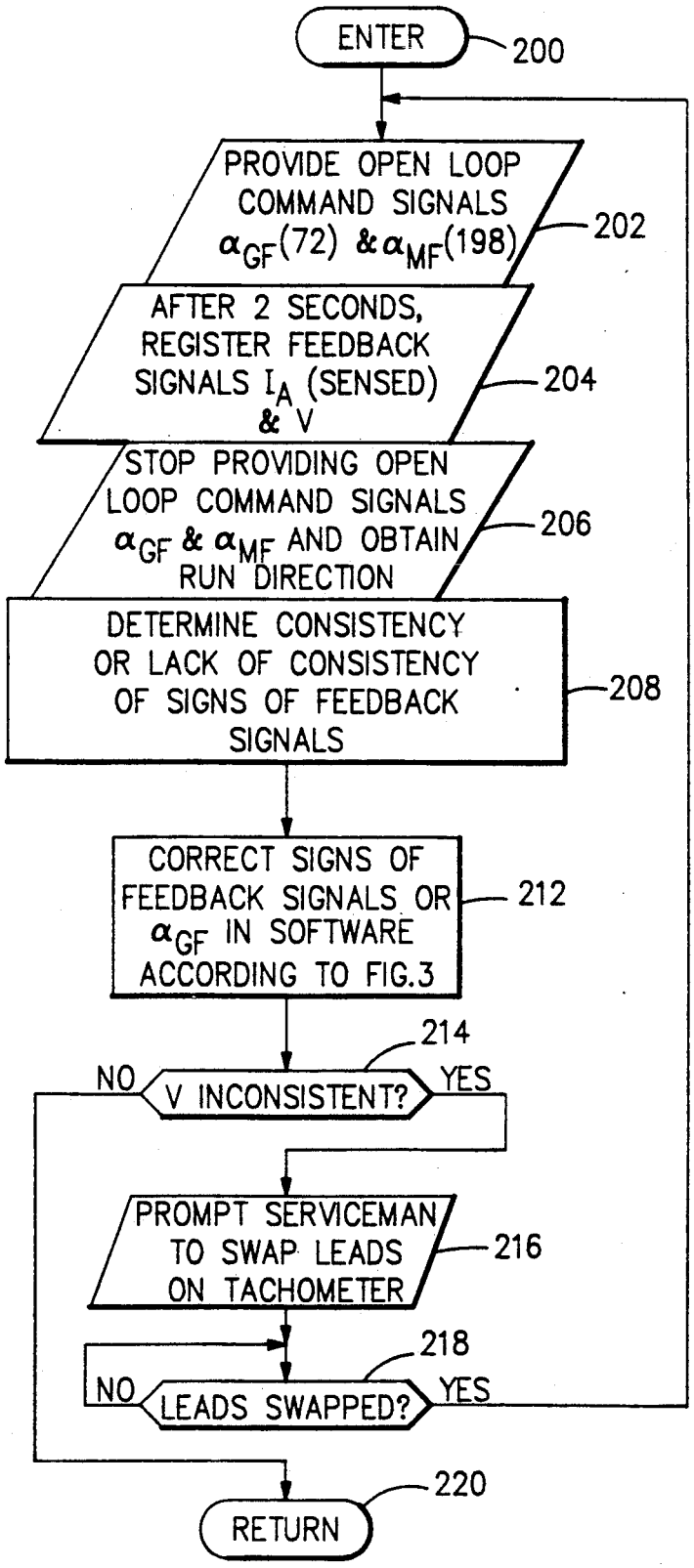
FIGS. 2A through 2F are flow charts showing methods for carrying out some of the specific teachings of the present invention on a system such as is disclosed in FIGS. 1A and 1C.

To summarize FIG. 2A, the drive system sets the elevator in movement using constant firing angle for the generator field and the motor field. In the case of no sign fault, all feedback signals have to be of the same polarity as the firing angles. The actual polarity of the armature current feedback depends on the torque condition of the motor. In order to be sure that the driving torque is a motoring one, independent from run direction or steady state load condition of the elevator car, the driving motor has to pull the elevator out of the brake.

This is achieved by setting first the firing angles and delayed opening of the mechanical holding brake 84. Brake delay is given by the natural time constant of the brake field winding; when using a closed loop controlled brake, a time delay in case of the sign test has to be added. Pulling the elevator out of the brake assures, in any case, a motoring torque and armature current in run direction, which gives the system the ability to make a decision about a sign fault of the armature current feedback. Experience shows that the instant of starting to move is well suited to determine or measure the feedback polarity.

Concerning the motor field current feedback, proper operation of the loop is assured by placing the actuator and current sensor on a PCB so that the polarity is not changed in the field site. Wrong connection of the motor field winding will determine wrong polarity of the motor torque and affect the stability of the velocity.

Figures 3, 4:
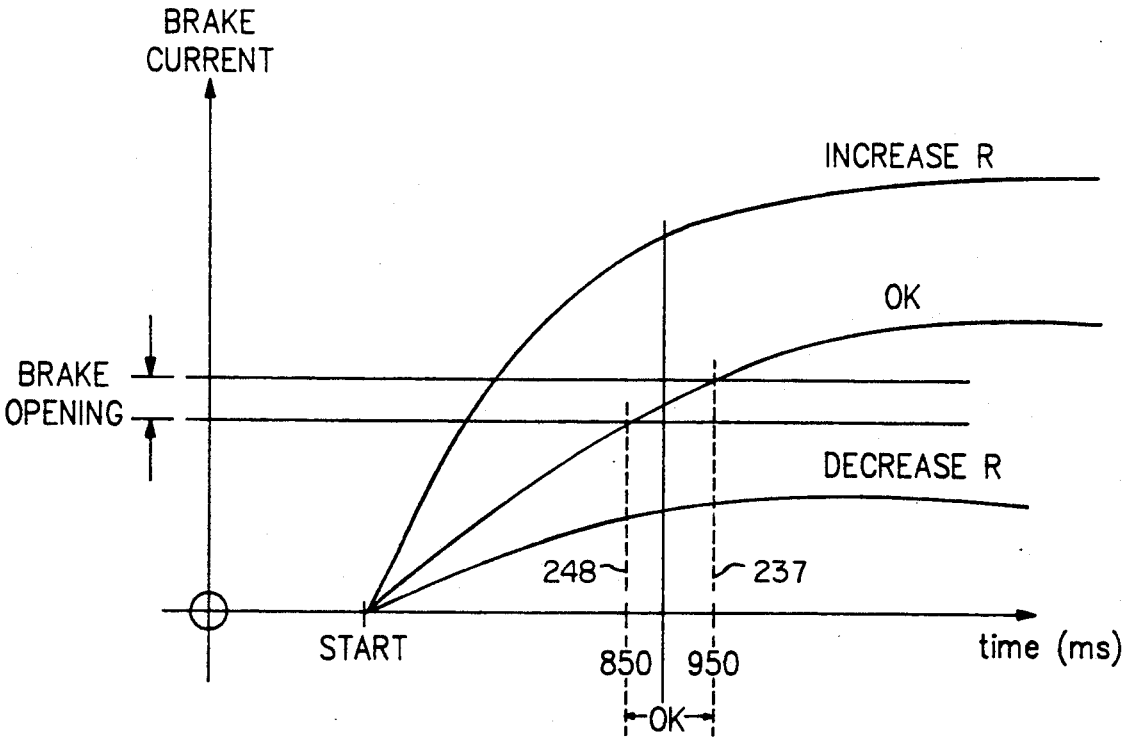
FIG. 3 is an illustration of a tabular method which may be carried out in accordance with the method of FIG. 2A and may be embodied in the software of FIGS. 1A and 1C.
FIG. 4 illustrates the effect of an adjustment in a brake resistor in a brake opening circuit which may be adjusted in accordance with the method of FIG. 2B and embodied in the stored software of FIGS. 1A and 1C.

After a prescribed run time of two seconds, the routine measures and registers the signs of the feedback signals. At that point, the elevator is stopped, and it is determined whether any sign faults exist, and if so, to correct any such wrong polarities in the feedback signals or actuator polarity by using a software table stored in EPROM 18, which is shown in FIG. 3. Depending on the combinations of signs (velocity, armature current, direction of car movement), the software procedure will internally change the polarity of the corresponding input (sensed armature current on line 64) or the output firing angle signal (APHA GF) on line 72.

In the case of a sign fault of the velocity feedback signal, such may also be corrected in software, or the tool 112 may be prompted to display the appropriate information (encoder connections to be changed) and be started again as soon as the serviceman indicates that the leads have been checked or swapped.

After successful polarity testing of the signals, the system can be operated in a closed loop mode; thus, the elevator can be moved to conduct further setups.

For a detailed example, referring to FIG. 2A, after entering at a step 200 in response to a serviceman request as entered by the test tool 112, a program is executed by the signal processor 10 of FIG. 1A in accordance with a series of steps which may be the same or similar to those shown in this figure. The steps are stored in a program in the EPROM 18. In the step 202, the DC generator field control signal on line 72 and the DC motor field control signal on line 56 (198, FIG. 1C) are provided by the signal processor 10 in an open loop fashion in order to cause the DC motor 32 to move slightly so that the direction of movement may be determined.

As indicated in a step 204, after a few seconds, the sign of the sensed armature current on line 64 is registered in the RAM 16 of the signal processor 10. Also, the sign of the sensed velocity signal on line 82 is registered as well. After registering the feedback signals, the open loop command signals on lines 72 and 56 are stopped, the elevator stops, and the observed run direction is obtained before changing signs as indicated in a step 206. Next, the consistency or lack of consistency in the signs of the feedback signals are determined as indicated in a step 208. This is done by consulting the table shown in FIG. 3. In case of a sign fault in the combination shown on the lefthand side of the table, then changes in the sign of the signals as received can be made in software by changing the interpretation of the received sign to its negation or by changing the sign of the generator field firing angle (ALPHA GF).

For example, a step 212 can be executed in which the interpretation of the signs of those feedback signals or the firing angle is changed in software according to FIG. 3. Or, if there is no inconsistency, a step 214 is executed in which a determination is made as to whether or not the sign of the sensed velocity signal is inconsistent with the observed run direction of the elevator car. If so, the interpretation of the sign can be negated in software, for example, as shown previously in connection with the armature current feedback, or, as shown in FIG. 2A, a prompt can be issued to the serviceman by means of the service tool 112 to swap the leads on the tachometer 80, as shown in step 216. Once the serviceman swaps the leads, he can make an entry on the service tool which will provide a signal on the line 113 to the signal processor 10 and a determination made in a step 218 that the leads have indeed been swapped, and the whole process can be repeated to ensure that sign consistency has now been achieved. If there is no inconsistency detected in a step 214, then a return can be directly made in a step 220.

2. Adjust brake control

According to the present invention, the adjustment of the brake resistor has to be made to obtain a smooth brake lifting in order to reduce the start jerk of the elevator. FIG. 4 shows a brake opening adjustment process, which is made by trying several different rates of current increase until the brake opening falls within a desired time range. For example, a time of $$850\ \text{ms} \leqq T \leqq 950\ \text{ms}$$

may be fixed to coincide with a smooth brake lifting (smooth lift current). Such may be defined as the time from the start of the brake opening until the first encoder 80 pulse is measured on line 82 when the brake 92 is lifted. The brake should be adjusted in a way such that the smooth lifting begins at this time. According to the measured time, a displayed instructional adjustment may be made, and the value of the variable brake resistance in the controller cabinet has to be then increased or decreased by the serviceman.

Figure 2B:
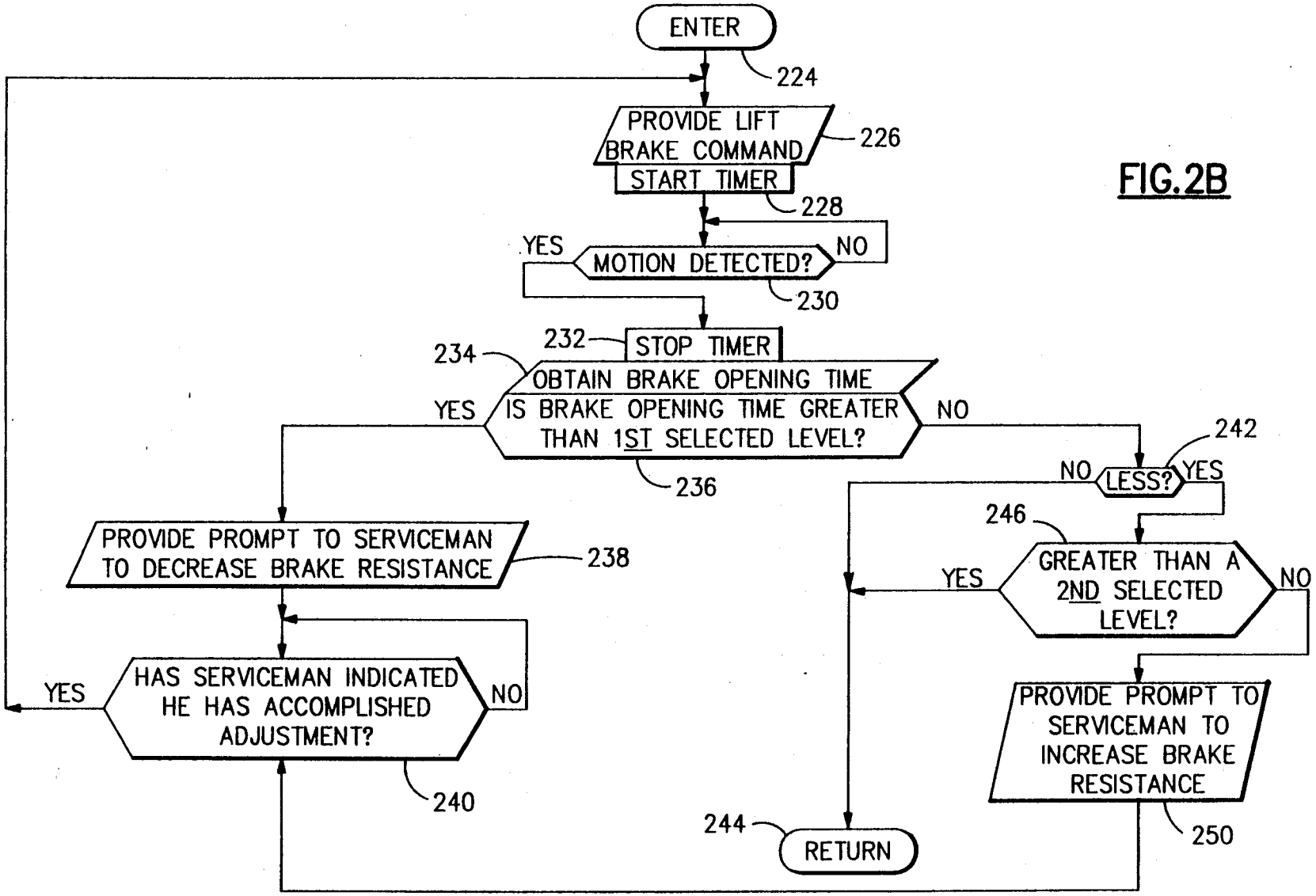

Referring now to FIG. 2B, after receiving a prompt from the serviceman through the service tool 112 over signal line 113, a series of steps is commenced by first entering in a step 224 and executing a step 226 in which a lift brake command is provided on the line 98 to the switch 84c of FIGS. 1A, 1B, and 1C. At that point, a timer is started as indicated in a step 228 and a wait state is entered until motion is detected as indicated in a step 230, at which point the timer is stopped as indicated in a step 232 and the brake opening time is obtained as indicated in a step 234. A determination is then made in a test 236 as to whether or not the brake opening time is greater than a first selected level 237, such as is shown in FIG. 4. If so, a prompt is provided as indicated in a step 238 to the serviceman by the tool 112 to decrease brake resistance by making an adjustment to the resistor 85 shown in FIGS. 1A, 1B, and 1C. This may be done in very small incremental steps until the brake resistance is exactly the correct value. A step 240 determines when the serviceman indicates by a return signal via the service tool that the adjustment has been made and the steps and tests 226, 236 are again executed as before.

If a determination were made in step 236 that the brake opening time was not greater than the first selected level 237, then a determination is made in a step 242 as to whether or not it is less than the level 237. If not, then it is equal and a return is made in a step 244. If it is less, then a determination is made in a step 246 as to whether or not brake opening time is greater than a second selected level 248, as shown in FIG. 4. If so, a return is made in step 244. If not, a prompt is provided as indicated in a step 250 to the serviceman to increase the brake resistance in a small step and after receiving an indication from the serviceman that the adjustment has been made, as determined in a step 240, then the entire program is run again, as before, until the brake resistance causes the first selected opening time level to either be equal to the first selected level 237 or to be less than that level and greater than the level 248.

3. Adjust motor field

The motor field current is a parameter which determines the field operating point of the motor. There are two different values of the required motor field current:

The rated motor field current, which represents the current at the rated speed and the rated armature voltage (full load).

The idle motor field current, which specifies the reduced current in the motor field when the elevator is at standstill and represents around 30% of the rated value.

Due to the linear relationship between motor speed and armature voltage, the setting of the motor field current may be done at low speed. For the beginning, the motor will be running at 25% of the rated speed and the starting or initial value of the motor field current will be a suitable value with respect to the applicable range of the motor, e.g., two Amps.

Figure 2C:
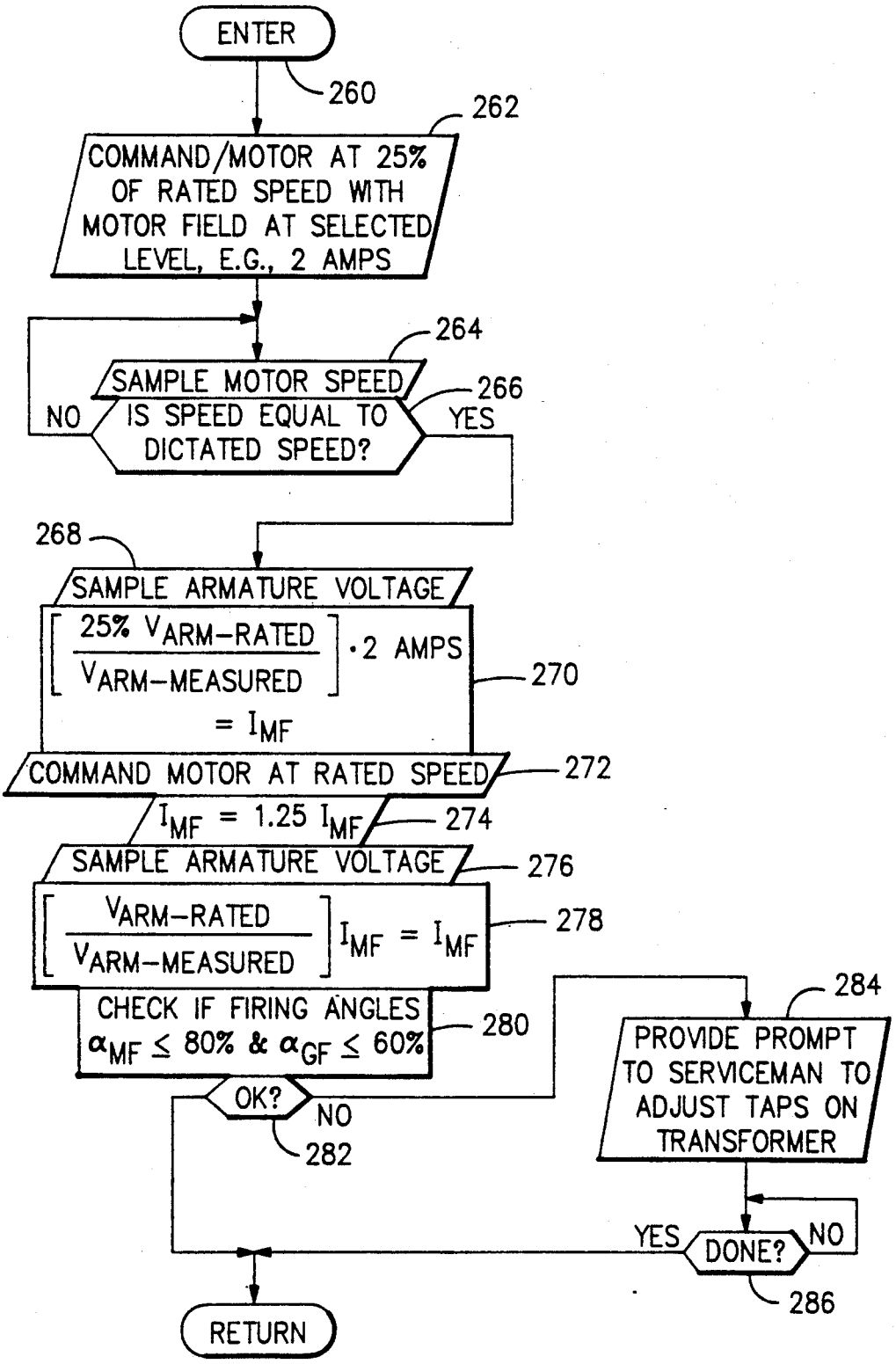

After entering at a step 260 in FIG. 2C, the drive system is commanded in a step 262 to a dictated speed of 25% rated speed, so the first phase of the adjustment can begin. After making sure the system is up to 25% of rated speed in steps 264, 266, the system measures the armature voltage and checks if it corresponds to the desired value (25% of the rated armature voltage) as shown in a step 268. According to the relationship (25% Varm-rated/Varm-measured), the new dictated field current will be calculated and delivered as shown in step 270.

During the second phase, the motor is commanded to run at the rated speed as shown in a step 272. Due to the saturation, the last calculated value of the motor field current will be incremented to Imf=Imf+25% * Imf as shown in a step 274. During the run at the rated speed, the measured armature voltage sampled in a step 276 is compared to the nominal value. The result of the relation (Varm-rated/Varm-measured) will be used to correct the motor field current calculated before and to deliver the final rated field current as shown in a step 278.

The adjustment is finished if the control reserve evaluation of the motor and the generator are in prescribed limits. These are, for example:

$$\text{Imf firing angle} \leqq 80\%$$

$$\text{Igf firing angle} \leqq 60\%$$

A special routine may be activated in parallel to the motor field current adjustment to measure the peak values of the firing angles during a constant run at the rated speed. The relationship between the measured values and the maximal values of the firing angles provides information which helps to set the corresponding transformer tap as shown in steps 280–286.

4. Adjust armature current control

The armature current controller 148 (FIG. 1C) may be an adaptive PI-controller as disclosed in copending application U.S. Ser. No. 07/589,859. To simplify the adjustment, the responses (Iarm-time-min, Iarm-time-max) are set to default values.

The gain (Iarm-gain-min, Iarm-gain-max) has to be adjusted according to the operating point, i.e., where the system is working, as limited by the discontinuous (Igf) current flow.

Figure 2E:
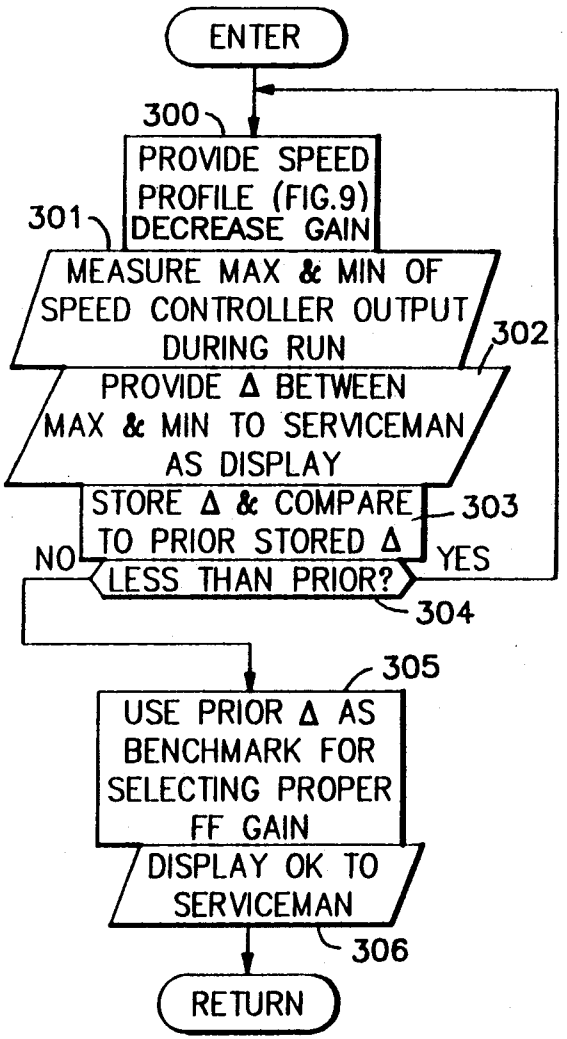
Figure 2D:
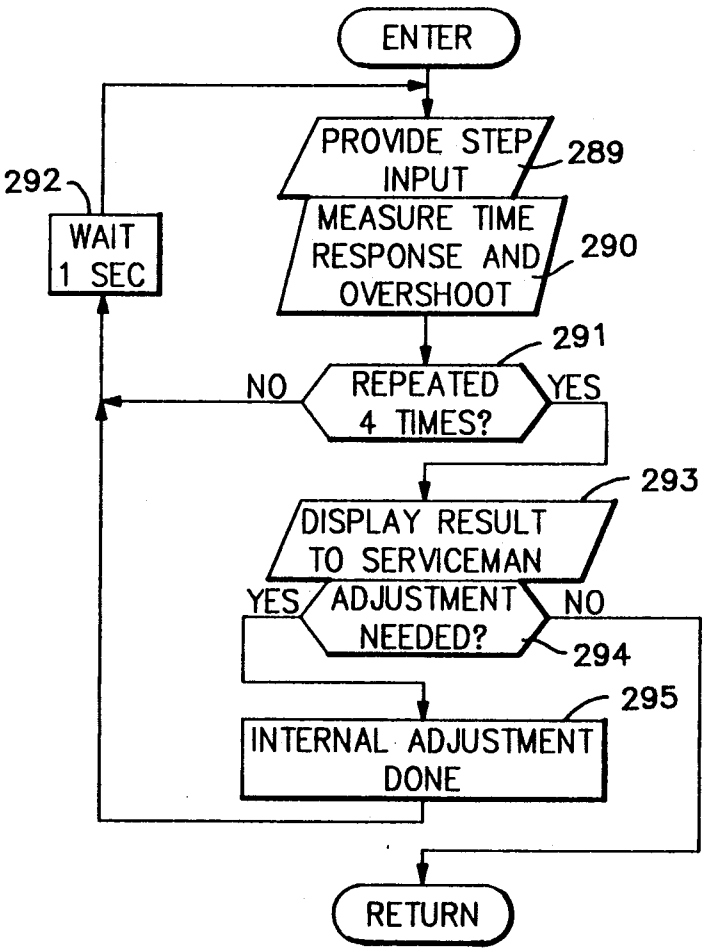

The parameter Iarm-gain-max will be adjusted, according to a procedure illustrated by way of example in FIG. 2D, in the discontinuous operation region, while the parameter Iarm-gain-min will be set in the continuous operation region.

There is one procedure to adjust both parameters for the different regions. It may switch from one to the other parameter adjustment using the tool 112.

Figure 5:
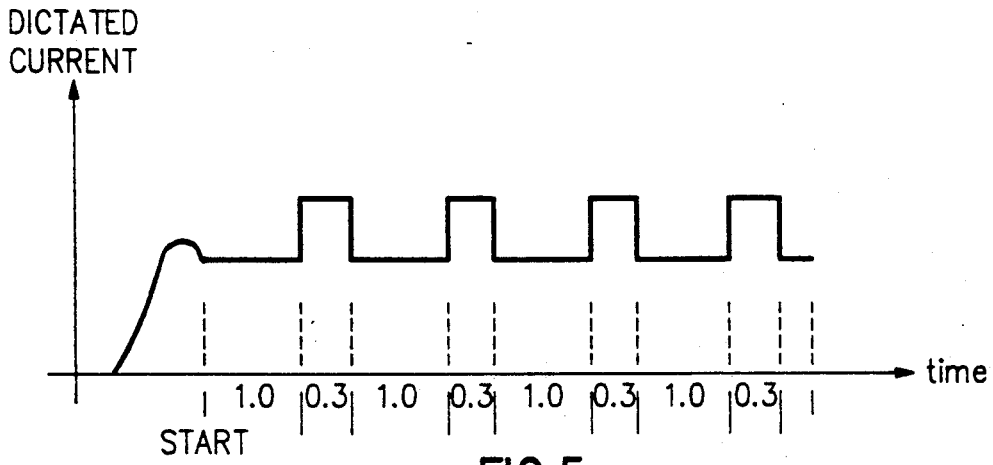
FIG. 5 is an illustration of dictated current during adjustment of the gain of the armature current regulator.

The performance criterion used to adjust the armature control loop is the step response (step 289, FIG. 2D). In fact, several steps are provided as shown in FIG. 5.

The step response is the measured reaction of a control system to a step change in the input. Although the present invention is not limited thereto, it of course has several favorable characteristics which have maintained its universal acceptance and popularity:

the step stimulus is easy to generate;

several measurement techniques are available for recording the time domain response to the step input; and key aspects of the control system's performance can be derived from the step response.

Figure 6:
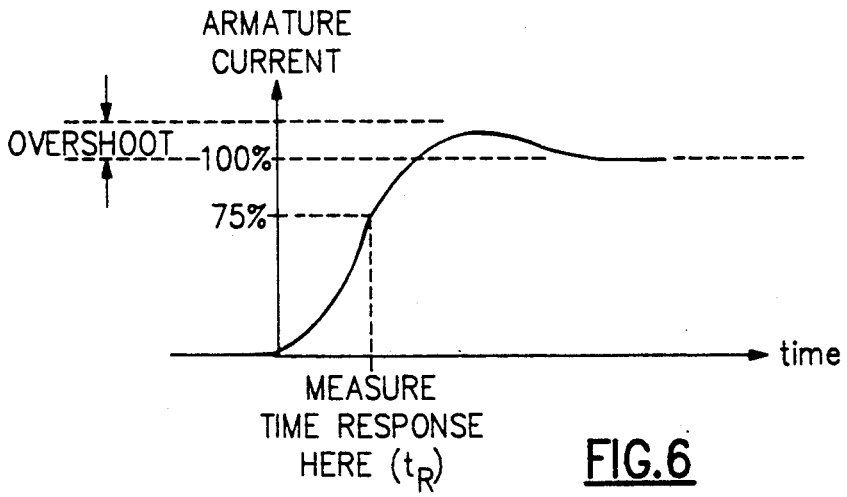
FIG. 6 is an illustration of the step response of the drive including overshoot.

The measures of performances (step 290, FIG. 2D) derived from the step response shown in FIG. 6 are:

the response time of the step response provides a measure of how fast the system can initially achieve the desired output level. In this case, the chosen maximum time is T=80 ms with a minimum of 60 ms; and the maximum overshoot (peak value or maximum value of transient deviation) provides a relative measure of the maximum output level resulting from a specific input (4%).

The function of the adjustment procedure is to ramp up the system until the prescribed discontinuous (for Iarm-gain-max) or continuous (for Iarm-gain-min) region is reached, and to start the measurement of the time response and overshoot (see FIG. 5).

This is done by checking a discontinuous current flow (DCF) signal which is fully described in copending application U.S. Ser. No. 07/589,859 and which indicates discontinuity in the sensed generator field current signal on line 76 of FIG. 1A in a steady state run condition. As the magnitude of the DCF signal is found to be out of a requested operational area, the system ramps up or down until the desired operating point of DCF is tracked.

To achieve reliable results, the procedure activates and evaluates the step response four times (step 291, FIG. 2D) before the result is displayed. There is a waiting time of one second (step 292, FIG. 2D) between two steps to allow a closed loop driving of the speed control and to check the prescribed adjustment area again. After a last step response, the system waits 0.2 seconds and checks the result before setting it as available and displaying at the service tool (step 293, FIG. 2D).

Figure 7:
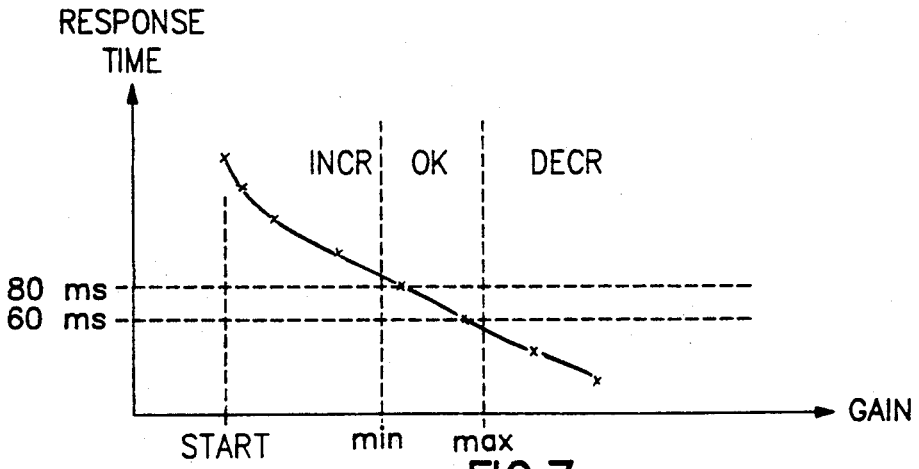
FIG. 7 is an illustration of response time variation of the drive system depending on gain.

Depending on the result, the parameter (armature current gain) will be incremented or decremented internally (step 295, FIG. 2D) and the procedure automatically started again. FIG. 7 shows the variation of the time response, which is mainly evaluated, depending on the parameter. The adjustment is finished, (step 294, FIG. 2D) for example, if the following results for the time (T) and the overshoot (OS) are:

$$60\ \text{ms} \leqq T \leqq 80\ \text{ms}\quad 0 \leqq OS \leqq 4\%$$

When the adjustment is finished, the system ramps down and stands still.

5. Adjust feed forward gain

Figure 9:
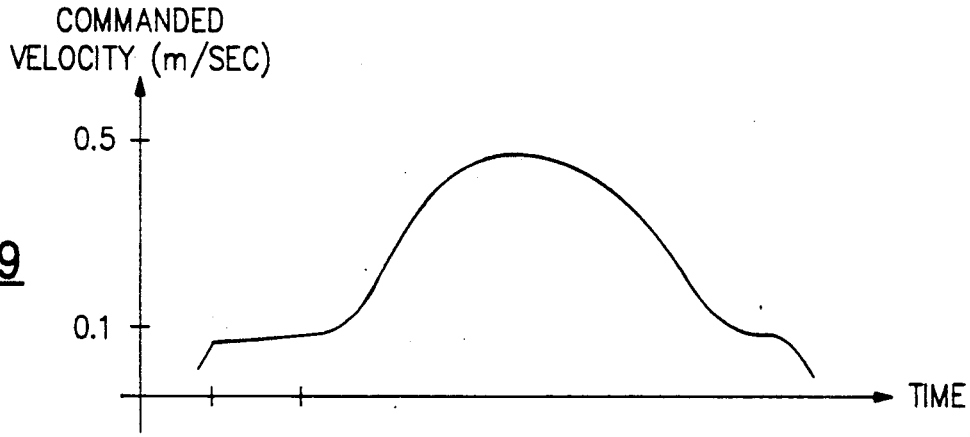
FIG. 9 is an illustration of a velocity profile.

To adjust the parameter "Feed gain", it is necessary to drive the elevator with a speed profile. A time profile with the following features $$V=0.4\ \text{m/s},\ Acc=1.0\ \text{m/s}^2,\ Jerk=1.5\ \text{m/s}^3$$

is implemented as a table function for speed and acceleration dictation. The elevator speed ramps up until the velocity 0.1 m/s is reached. After a constant run of one second, it will be accelerated and decelerated with the time profile (FIG. 9).

Figure 8:
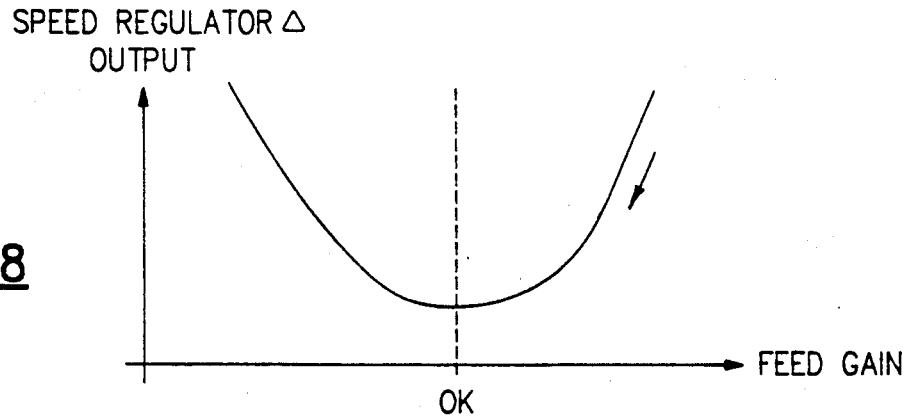
FIG. 8 is an illustration of the output of a speed regulator depending on the feed forward gain.
Figure 10A:
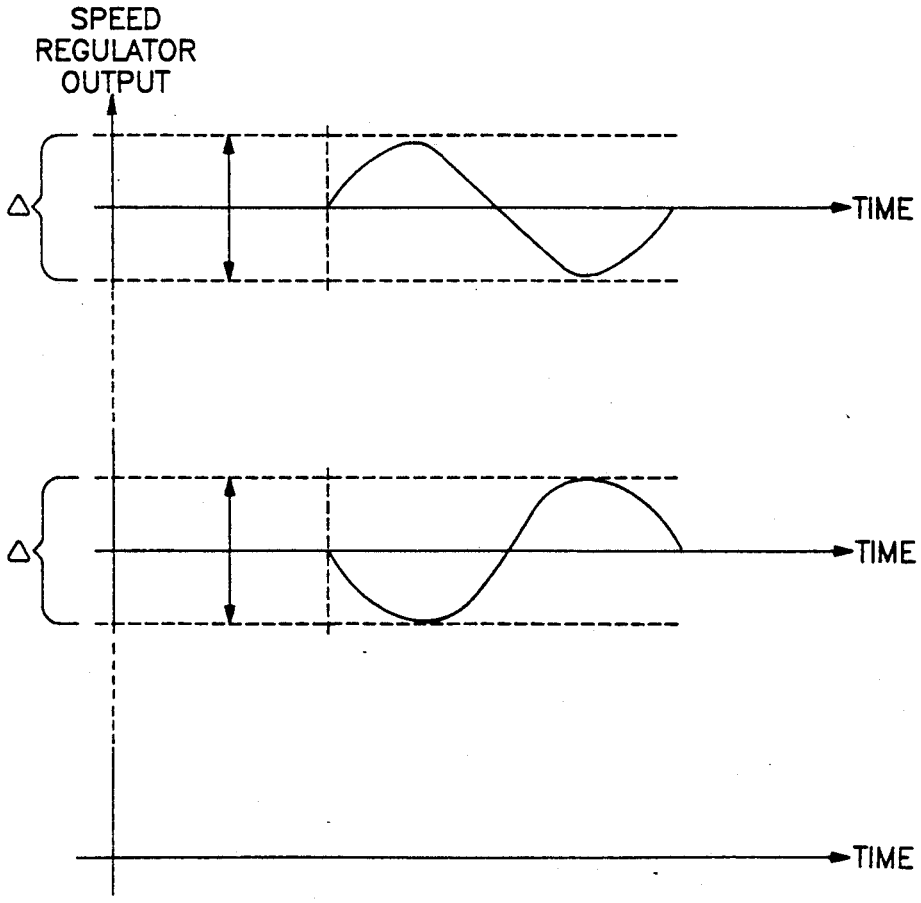
FIG. 10 is made up of three plots of speed regulator output on a common time line illustrating feed forward gain too low, too high, and optimized.

The adjustment routine shown in FIG. 2E starts simultaneously with the profile (step 300) and measures the maximum and the minimum of the speed controller output (step 301). The difference between both values will be displayed as an adjustment result (step 302). The procedure compares the actual and the old evaluated result to determine the lowest value for the result (step 303). Best adjustment is obtained when the lowest result (step 304) is reached. FIG. 8 shows the characteristic of the prescribed speed controller output measurement results at different gains, while FIG. 10 shows the variation in time of speed regulator output for three different gains. FIG. 10(*a*) shows feed forward gain too low, 10(*b*) shows it too high, and 10(*c*) shows it optimized.

The adjustment will be started with a high gain of, e.g., "500". This will be decremented (step 300) in steps of "20" as shown in the direction of an arrow 300 in FIG. 8 as long as the evaluation of measurement results delivers decreasing Δ values. The adjustment will be continued until the parameter is well tuned, the gain is selected as the next prior gain (step 305), and the result is "OK" is displayed (step 306). In this case, the system ramps down and stops.

6. Adjust start time

Figure 11:
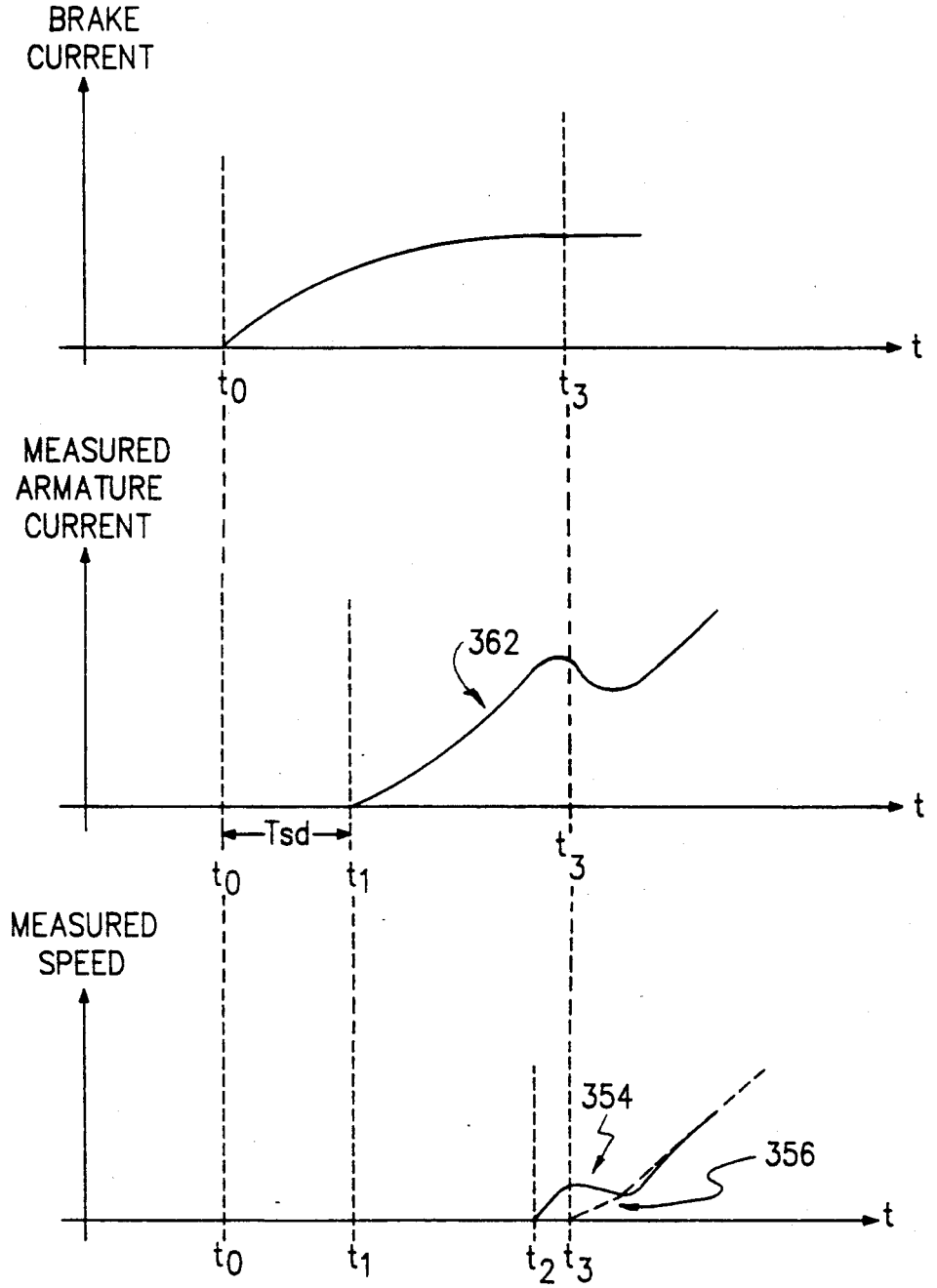
FIG. 11 shows three plots on a common time line of brake current, measured armature current, and measured speed which shows a needed start time adjustment.

The adjustment of the start time, according to the present invention, allows reduction of the jerk at the start of each run. We define the start time delay ($t_{sd}$) as the time between the initiation of smooth brake lifting and the beginning of the start-jerk-reduction-routine, which increases the armature current in the desired run direction at a creep speed of 5 mm/s. FIGS. 11(*a*), (*b*) and (*c*) show the variation in time on a common time line of the measured drive signals (brake current, armature current speed). The current will be increased until the car moves in the desired run direction which will cause the end of the jerk reduction.

Figure 12:
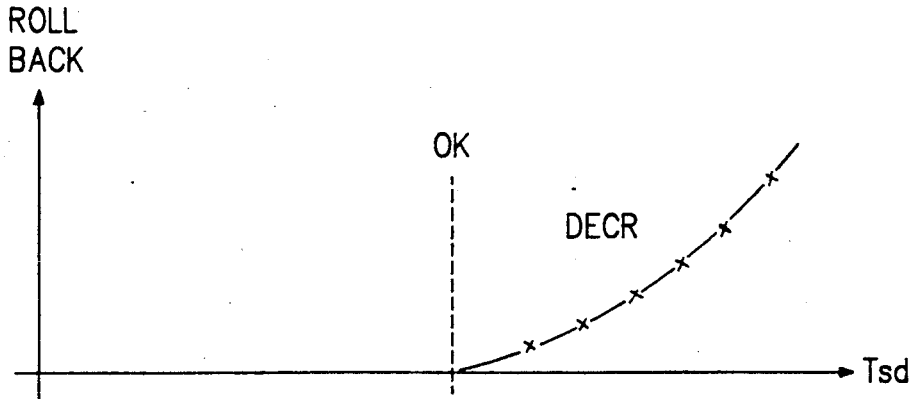
FIG. 12 shows an adjustment of rollback in order to determine the time delay of FIG. 11.

The adjustment will be started using the prescribed parameter "1500 ms" for $t_{sd}$. In case of a no load down run condition, this initial parameter will cause a sagging of the car in the up direction due largely to a delayed starting of the armature current profile. Start time delay will be decremented by steps, according to the result of the measurement, until no sagging of the car, i.e., no rollback, occurs. A pause of two seconds is set between each adjustment to allow a complete brake closing. The adjustment will be finished if the measured result, i.e., the rollback, is zero. FIG. 12 shows the adjustment result depending on the parameter.

Figure 2F:
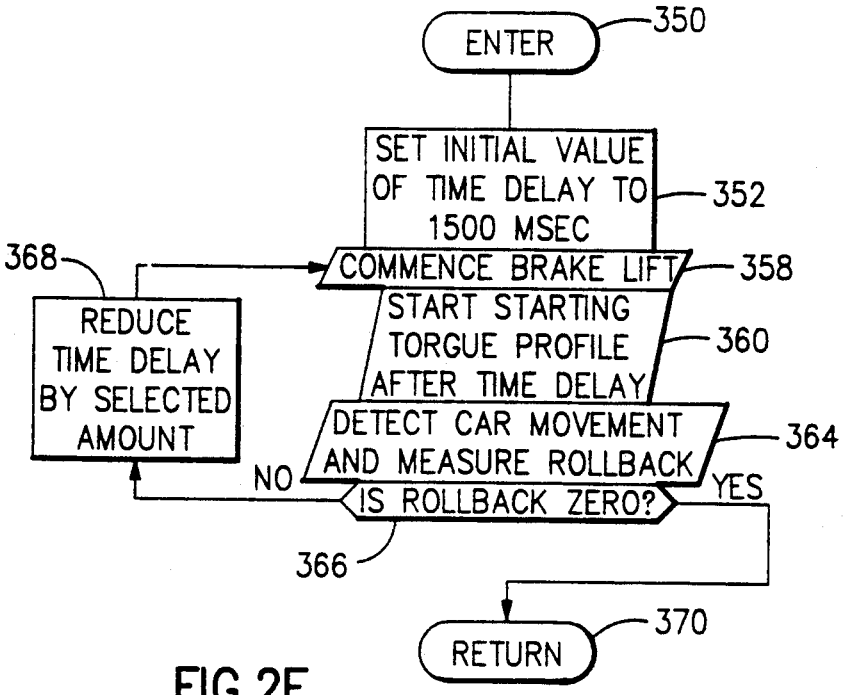

Referring to FIG. 2F, a flow chart is there shown for carrying out the above-described steps. These logical steps will be of course stored in the EPROM 18 of the signal processor 10 of FIG. 1A and will be executed by the signal processor in conjunction with the serviceman using his service tool to cause the program to commence. After receiving such a commanded commencement signal on line 113, an entrance to the program is made at a step 350, and the initial value of the time delay ($t_{sd}$) of FIG. 11(*b*) is set at an initial value of 1500 milliseconds in a step 352. This is the time delay from the time ($t_0$) at which the lift brake current commences until the starting torque profile is started at time $t_1$. As shown in FIG. 11(*c*), a car starts to move at time $t_2$, at which time the speed profile is commanded to commence. The actual measured speed is shown in FIG. 11(*c*) by a plot 354 while the dashed line 356 represents the speed profile.

Turning to FIG. 2F, the commencement of brake lift is shown in a step 358 after which a step 360 is executed in which the starting torque profile 362 of FIG. 11(*b*) is started at time $t_1$ after the time delay $t_{sd}$. Once motion is detected in a step 364, the amount of rollback is measured and stored. If not zero, as detected in a step 366, the time delay is reduced by a selected amount as shown in a step 368 and steps 358, 360, 364, 366 are repeated until rollback is zero, at which point a return is made in a step 370.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention.

We claim:

1. A method for checking and automatically correcting signals for controlling an elevator system, comprising the steps of:

providing a torque command signal for causing said elevator to move;

registering sensed signals indicative of said movement;

stopping said movement;

comparing the signs of said sensed signals to a stored sign reference signal table and providing a change signal indicative of any changes required in selected sensed signals due to any difference between the signs stored in said reference table and said sensed signals; and automatically changing the signs of said selected sensed signals.

2. A method for checking and automatically correcting an elevator motor field current, comprising the steps of:

providing a speed command signal having a magnitude indicative of a fraction of rated speed;

providing a selected motor field current less than rated;

sampling a sensed armature voltage signal having a magnitude indicative of said motor's speed; and comparing the magnitude of a stored signal indicative of said same fraction of rated armature voltage at rated speed to the magnitude of said sampled armature voltage signal and automatically adjusting the magnitude of said motor field current in proportion to said comparison and providing an adjusted motor field current.

3. A method for checking and automatically correcting the gain of an armature control, comprising the steps of:

providing a step armature current command signal;

determining the magnitude of a sensed armature current signal at a selected time after providing said command signal;

comparing said magnitude of said sensed armature current signal to a stored reference signal and providing an adjustment signal in proportion to the magnitude of the difference therebetween; and automatically adjusting said gain in response to said adjustment signal.

4. A method for checking and automatically correcting the gain of a feed forward control, comprising the steps of:

providing a speed profile command signal for a speed controller;

measuring the magnitude of said speed controller's output signal after providing said command signal;

comparing said magnitude of said measured speed controller output signal to a stored reference signal and providing an adjustment signal in proportion to the magnitude of the difference therebetween; and automatically adjusting said feed forward gain in response to said adjustment signal.

5. A method for checking and automatically correcting a feed forward gain for a speed regulator, comprising the steps of:

setting the feed forward gain at a selected magnitude;

providing a selected speed profile command signal;

registering the maximum and minimum magnitudes of speed regulator output and providing a difference signal indicative of the difference therebetween;

automatically adjusting said feed forward gain to zero said difference signal.

6. A method for checking and automatically correcting a start time for starting an elevator, comprising the steps of:

setting an initial time delay at a magnitude greater than a final acceptable magnitude;

commencing brake lift;

starting a start torque profile after said initial time delay;

detecting elevator movement and measuring rollback; and automatically reducing said time delay and repeating said steps of commencing, starting and detecting until said rollback is zero.

7. A method for checking and automatically correcting a time delay for a routine for reducing start jerk, comprising the steps of:

providing a lift brake command signal;

providing, in response to said lift brake command signal, a torque command signal after the time delay after providing lift brake command signal;

sampling the magnitude of a sensed position signal indicative of rollback; and automatically adjusting dead time delay in proportion to the magnitude of said position signal.

8. A method for checking and automatically correcting an elevator control parameter, comprising the steps of:

providing a signal for generating a step function for an armature current feedback control loop;

measuring the magnitude of a sensed armature current signal indicative of a response of the current loop to said step function;

comparing the magnitude of said sensed armature current signal to the magnitude of a stored reference signal indicative of the magnitude of said step function and providing a difference signal indicative of any difference therebetween;

measuring a selected response time and comparing same to a stored signal indicative of a selected reference time and providing a time difference signal indicative of the difference therebetween; and automatically adjusting said control parameter in proportion to the magnitudes of said difference signal and said time difference signal.

9. A method for checking and automatically correcting an elevator system's response to a control parameter, comprising the steps of:

providing a signal by means of a service tool, for causing said response in accordance with a sequence of steps stored in said elevator system wherein said elevator system, after executing said stored steps, provides a sensed signal indicative of said response;

comparing the magnitude of said sensed signal to a stored reference signal magnitude and providing a comparison signal indicative of a comparison therebetween; and wherein said elevator system automatically adjusts said response to said control parameter in response to said comparison signal.

* * * * *